US009381755B2

(12) United States Patent
Maza et al.

(10) Patent No.: US 9,381,755 B2
(45) Date of Patent: Jul. 5, 2016

(54) PLATEN WITH DIAGONAL SUBSTRATE SUPPORT SURFACES

(75) Inventors: Jesus Garcia Maza, Barcelona (ES); David Claramunt Morera, Sant Esteve Sesrovires (ES); Antonio Hinojosa Trigo, Rub (ES); Daniel Gutierrez Garcia, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/397,592

(22) PCT Filed: Jul. 26, 2012

(86) PCT No.: PCT/US2012/048240

§ 371 (c)(1),
(2), (4) Date: Nov. 6, 2014

(87) PCT Pub. No.: WO2014/018033

PCT Pub. Date: Jan. 30, 2014

(65) Prior Publication Data

US 2015/0085044 A1 Mar. 26, 2015

(51) Int. Cl.

| | |
|---|---|
| ***B41J 11/02*** | (2006.01) |
| ***B41J 11/00*** | (2006.01) |
| ***B41J 11/06*** | (2006.01) |

(52) U.S. Cl.

CPC ..... *B41J 11/02* (2013.01); *B41J 11/0085* (2013.01); *B41J 11/06* (2013.01)

(58) Field of Classification Search

None

See application file for complete search history.

(56) References Cited

U.S. PATENT DOCUMENTS

| | | | | |
|---|---|---|---|---|
| 6,736,501 | B2 | 5/2004 | Yamaguchi et al. | |
| 7,040,825 | B2 | 5/2006 | Asada et al. | |
| 7,441,858 | B2 * | 10/2008 | Hoshiyama | B41J 11/0065 347/16 |
| 7,946,700 | B2 | 5/2011 | Rufes et al. | |
| 8,152,296 | B2 | 4/2012 | Maekawa et al. | |
| 2008/0128545 | A1 * | 6/2008 | Midorikawa | 242/596 |
| 2008/0180508 | A1 | 7/2008 | Ota | |
| 2010/0220165 | A1 * | 9/2010 | Maekawa | B41J 11/0025 347/104 |
| 2011/0279529 | A1 | 11/2011 | Love et al. | |
| 2013/0162742 | A1 * | 6/2013 | Inoue et al. | 347/104 |

FOREIGN PATENT DOCUMENTS

| | | |
|---|---|---|
| EP | 1621357 | 2/2006 |
| JP | 10071711 | 3/1998 |
| JP | 2001088375 | 4/2001 |
| JP | 2003094742 | 4/2003 |
| JP | 2005138305 | 6/2005 |

OTHER PUBLICATIONS

Korean Intellectual Property Office, International Search Report of PCT/US2012/048240 dated Mar. 28, 2013 (2 pages).

* cited by examiner

*Primary Examiner* — Stephen Meier
*Assistant Examiner* — Renee I Wilson
(74) *Attorney, Agent, or Firm* — HP Inc. Patent Department

(57) ABSTRACT

In one example, a platen for supporting a print substrate includes multiple support surfaces that together define the full extent of a substrate support area of the platen. Each support surface is oriented parallel to other support surfaces along a line that is oblique to a direction the print substrate is to pass over the support surfaces when the platen is in use in a printer or other liquid dispenser.

13 Claims, 8 Drawing Sheets

PLATEN WITH DIAGONAL SUBSTRATE SUPPORT SURFACES

CROSS-REFERENCE TO RELATED APPLICATION

This application is a national stage application under 35 U.S.C. §371 of PCT/US2012/048240, filed Jul. 26, 2012.

BACKGROUND

Inkjet printers using water based inks, sometimes called latex inks, can print on a wide range of substrates. To improve durability of the printed image, after the ink is applied the wet substrate is heated and then cooled (or allowed to cool) to dry and cure the ink. Many print substrates deform during printing, drying and curing. Plastic based print substrates usually contract when heating up and expand when cooling down. Paper based print substrates expand and contract in response to changes in moisture content more so than in response to temperature changes. In either case, latex printers must account for changes in the print substrate during printing, drying and curing.

DRAWINGS

FIGS. 1-3 are plan and elevation views illustrating a scanning printhead type inkjet printer implementing one example of the new substrate support platen. The elevation view of FIG. 2 is taken along the line 2-2 in FIG. 1. The elevation view of FIG. 3 is taken along the line 3-3 in FIG. 2.

The same part numbers designate the same or similar parts throughout the figures.

DESCRIPTION

The examples shown in the figures and described below illustrate but do not limit the invention, which is defined in the Claims following this Description.

A ribbed platen is one way to control substrate deformation during inkjet printing, drying and curing. The print substrate can expand down into the regions between ribs to help prevent the substrate from expanding up into the printheads. While a ribbed platen allows the print substrate to expand in a controlled way, the multiple surface contacts sometimes create different temperature regions that appear in the printed image. To avoid this type of image defect, the platen ribs are sometimes curved rather than straight so that the ribs do not always touch the same part of the substrate. Sinusoidal curved platen ribs, for example, have been used effectively to control substrate deformation and reduce image quality defects in latex inkjet printers. Even with sinusoidal curved ribs, however, small sinusoidal shapes are sometimes still noticeable in the printed image, usually as parallel light and dark areas on solid fill image areas. This banding may be caused by different temperatures in the substrate due to contact with the ribs and no contact between the ribs and/or by ink drop placement errors due to different printhead-to-substrate spacing where the spacing is smaller along the ribs and larger between the ribs.

A new platen has been developed to help control substrate deformation during printing, drying and curing while reducing or eliminating visible banding. In one example, the new platen includes multiple support surfaces each oriented parallel to other support surfaces along a line that is oblique to the direction the substrate passes over the platen. These diagonal support surfaces may be implemented, for example, as a group of ribs that are all parallel to one another across the full extent of the platen. The diagonal support surfaces may be implemented, for another example, in two groups of parallel ribs that converge toward one another or diverge away from one another in the substrate direction.

As used in this document, "liquid" means a fluid not composed primarily of a gas or gases; a "platen" means a supporting structure or multiple supporting structures and is not limited to a flat plate; and a "printhead" means that part of an inkjet printer or other inkjet type dispenser that dispenses liquid from one or more openings, for example as drops or streams. A printhead is not limited to printing with ink but also includes inkjet type dispensing of other liquids and/or for uses other than printing.

Figure 1:
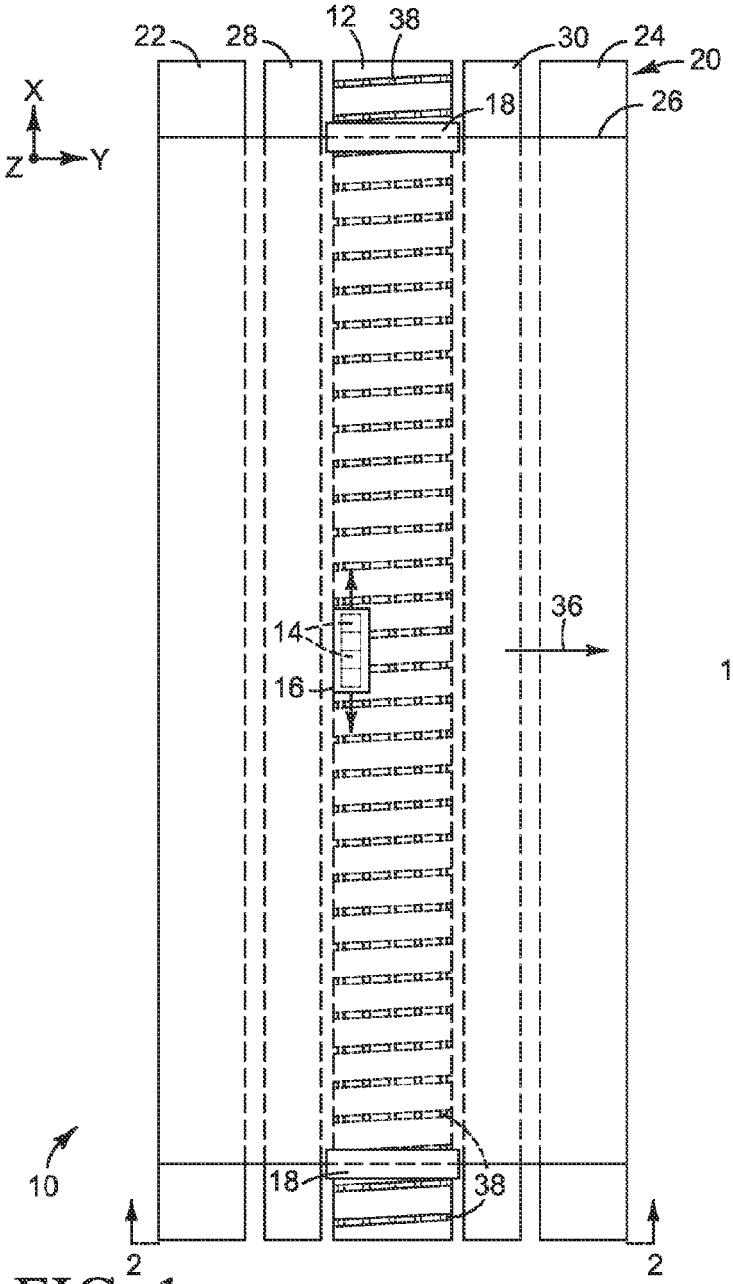
Figure 3:
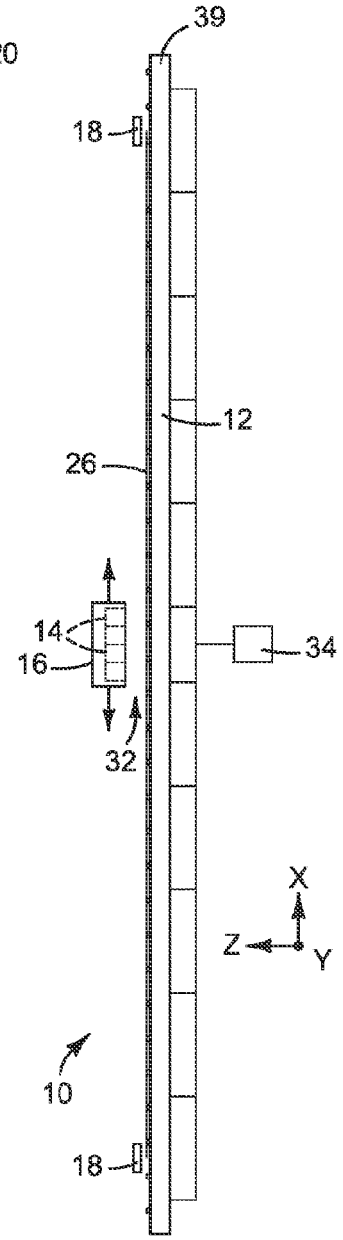
Figure 2:
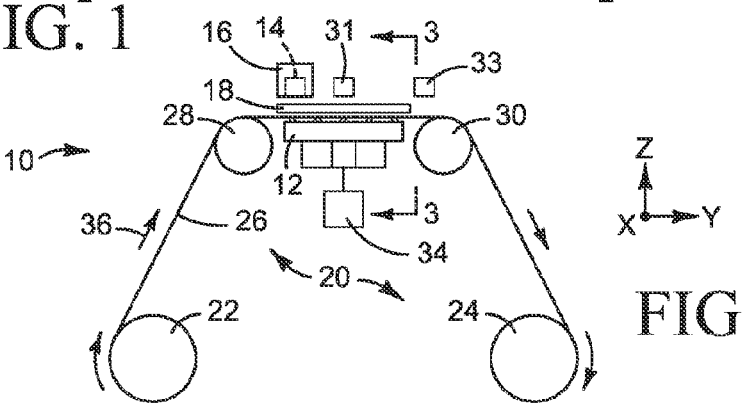

FIGS. 1-3 are plan and elevation views illustrating an inkjet printer 10 in which a new substrate support platen 12 is implemented. Referring to FIGS. 1-3, printer 10 includes a group of multiple printheads 14, for example to dispense different color inks. Printheads 14 are mounted on a carriage 16 over platen 12. A substrate transport 20 in printer 10 includes a web supply roller 22 and a web take-up roller 24. A web print substrate 26 extends from supply roller 22 over platen 12 and intermediate rollers 28, 30 to take-up roller 24. Intermediate rollers 28, 30, for example, help control the direction and tension of web 26 through a print zone 32 over platen 12. Printheads 14 dispense ink as they are scanned back and forth on carriage 16 across substrate 26 as it passes over platen 12 through print zone 32.

An infrared lamp or other suitable dryer 31 heats the wet ink just downstream from printheads 14 and the ink is fully cured at a curing station 33. Curing station 33 may include, for example, an infrared lamp and air flow. To avoid obscuring other parts, dryer 31 and curing station 33 are only shown in FIG. 2. Edge guides 18 may be used if necessary or desirable to keep the side edges of print substrate 26 flat on platen 12 through print zone 32. In the example shown, an air pump or other suitable vacuum source 34 is operatively coupled to platen 12 to exert a hold-down force on print substrate 26. As described in more detail below, platen 12 includes multiple diagonal parallel ribs 38 that support substrate 26 through print zone 32.

Figure 4:
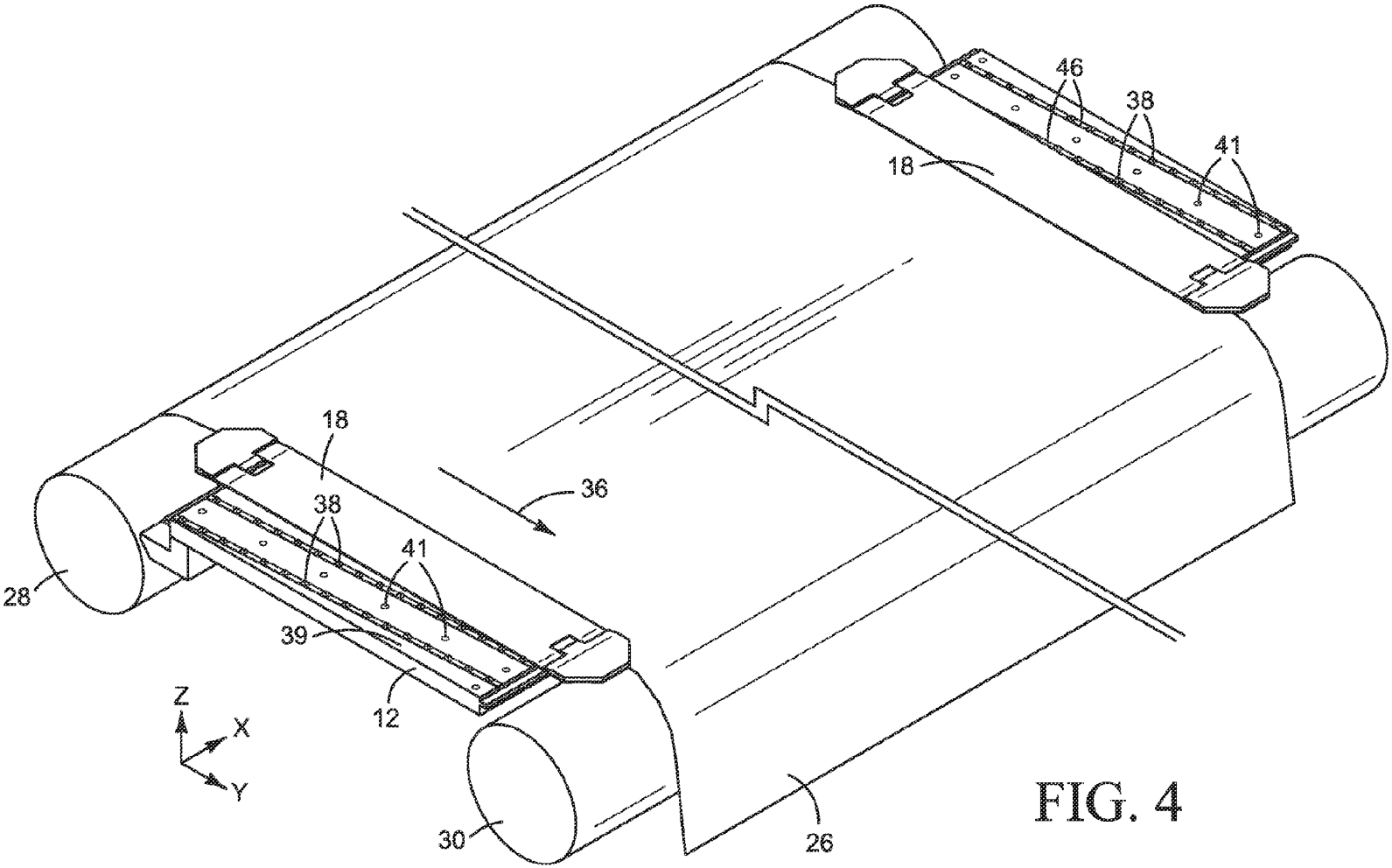
FIGS. 4-9 illustrate one example of the new platen in which the substrate support ribs slant diagonally to the left (in the substrate direction) parallel to one another across the full extent of the platen.
Figure 5:
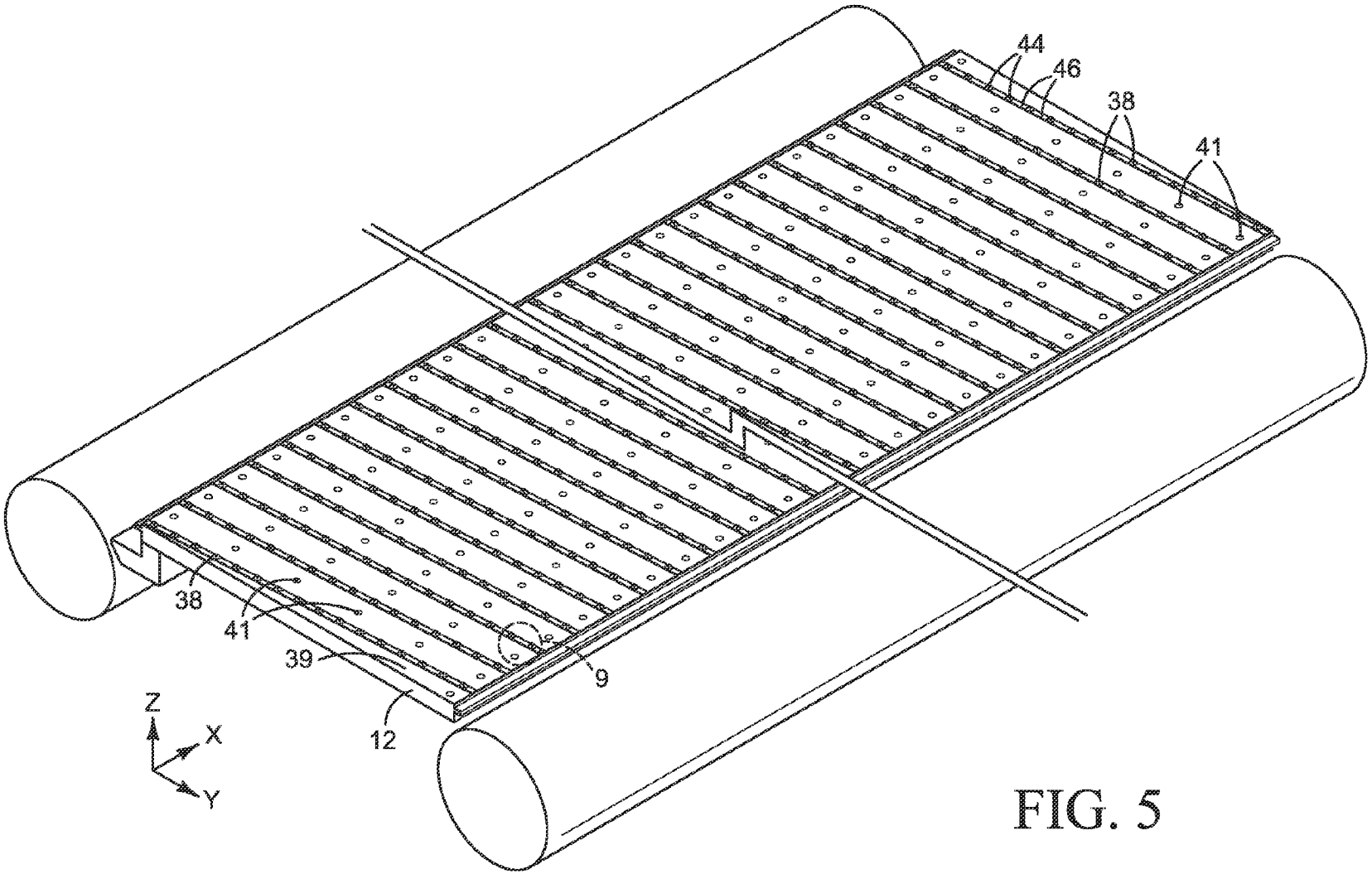
Figure 6:
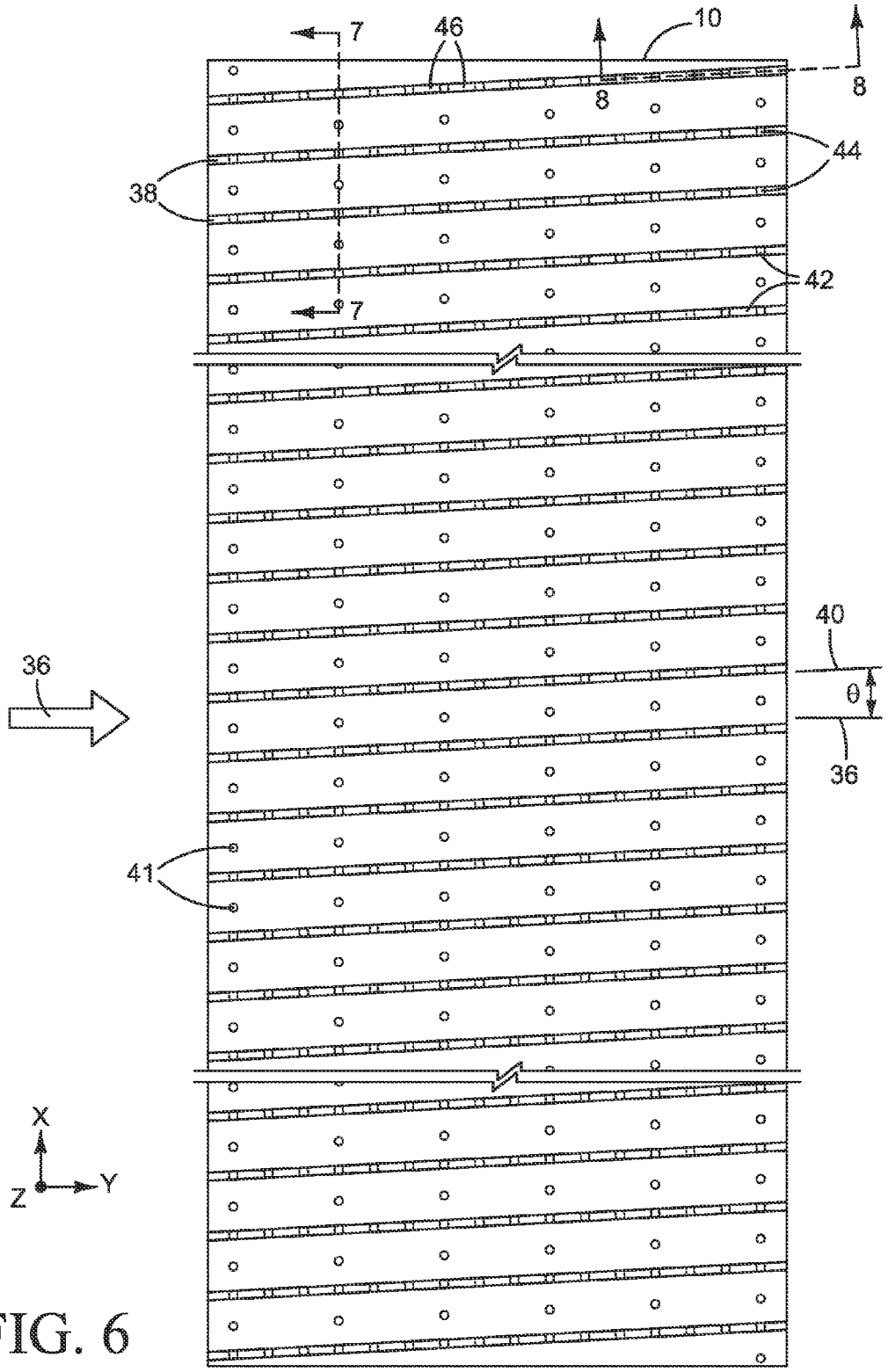
Figure 7:
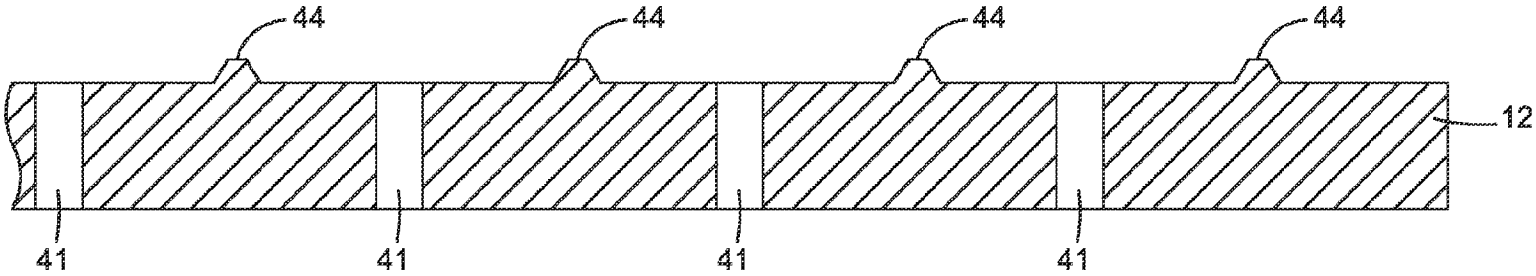
Figure 8:
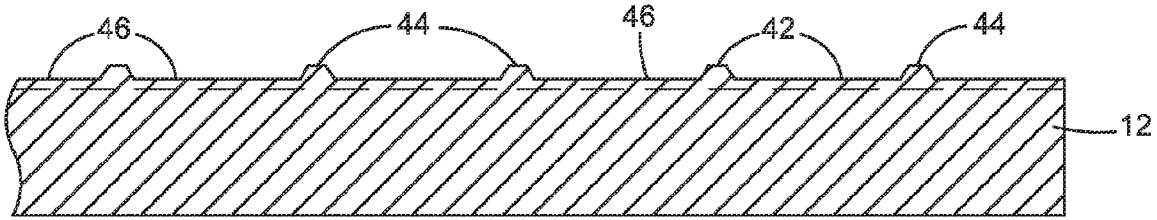
Figure 9:
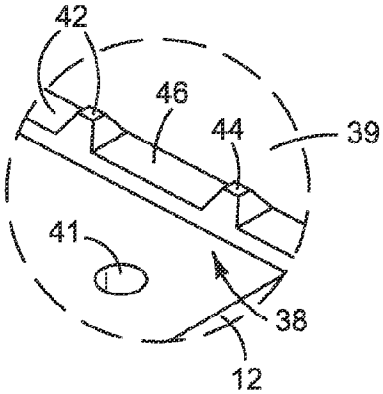

FIGS. 4-9 show platen 12 from FIG. 1 in detail. FIGS. 4 and 5 are perspective views showing print zone 32. Print substrate 26 is omitted from FIG. 5 to show the entire top part of platen 12. FIG. 6 is a plan view of platen 12, FIGS. 7 and 8 are section views taken along the lines 7-7 and 8-8 in FIG. 6, and FIG. 9 is a detail perspective view of part of platen 12 from FIG. 5. "Upstream" and "downstream" refer to the direction substrate 26 moves through print zone 32. "Length" is along the Y direction, the direction substrate 26 moves through print zone 32. "Width" is across in the X direction, perpendicular to the direction substrate 26 moves through print zone 32. Thus, in the examples shown in the figures, platen 12 is much wider than it is long. The direction print substrate 26 moves through print zone 32 is indicated by arrow 36 in the figures.

Referring to FIGS. 4-9, platen 12 includes multiple ribs 38 protruding from a base 39. In the example shown, ribs 38 are slanted diagonally to the left (in the substrate direction 36) parallel to one another across the full extent of the substrate support area of platen 12. Thus, each rib 38 is oriented parallel to all of the other ribs along a line 40 that is oblique to the direction 36 substrate 26 passes over platen 12. In another example, shown in FIG. 10, ribs 38 are slanted diagonally to the right in the substrate direction 36.

Holes 41 in platen 12 are operatively connected to an air pump or other suitable vacuum source 34 (FIGS. 2 and 3) to establish low pressure between platen 12 and substrate 26 to help hold substrate 26 against platen 12. A vacuum platen 12 is commonly used in large format roll-to-roll web feed printers such as printer 10 shown in FIGS. 1-3. Examples of the new platen, however, are not limited to vacuum platens but could also be implemented in non-vacuum platens. Each rib 38 presents a surface 42 to support substrate 26 on platen 12. In each of the examples shown, as best seen in FIGS. 7-9, each support surface 42 rises and falls along peaks 44 and valleys 46 so that substrate 26 is supported primarily on peaks 44. Although each rib support surface 42 could be flat, the peak/valley topography helps dissipate heat during drying.

Figure 10:
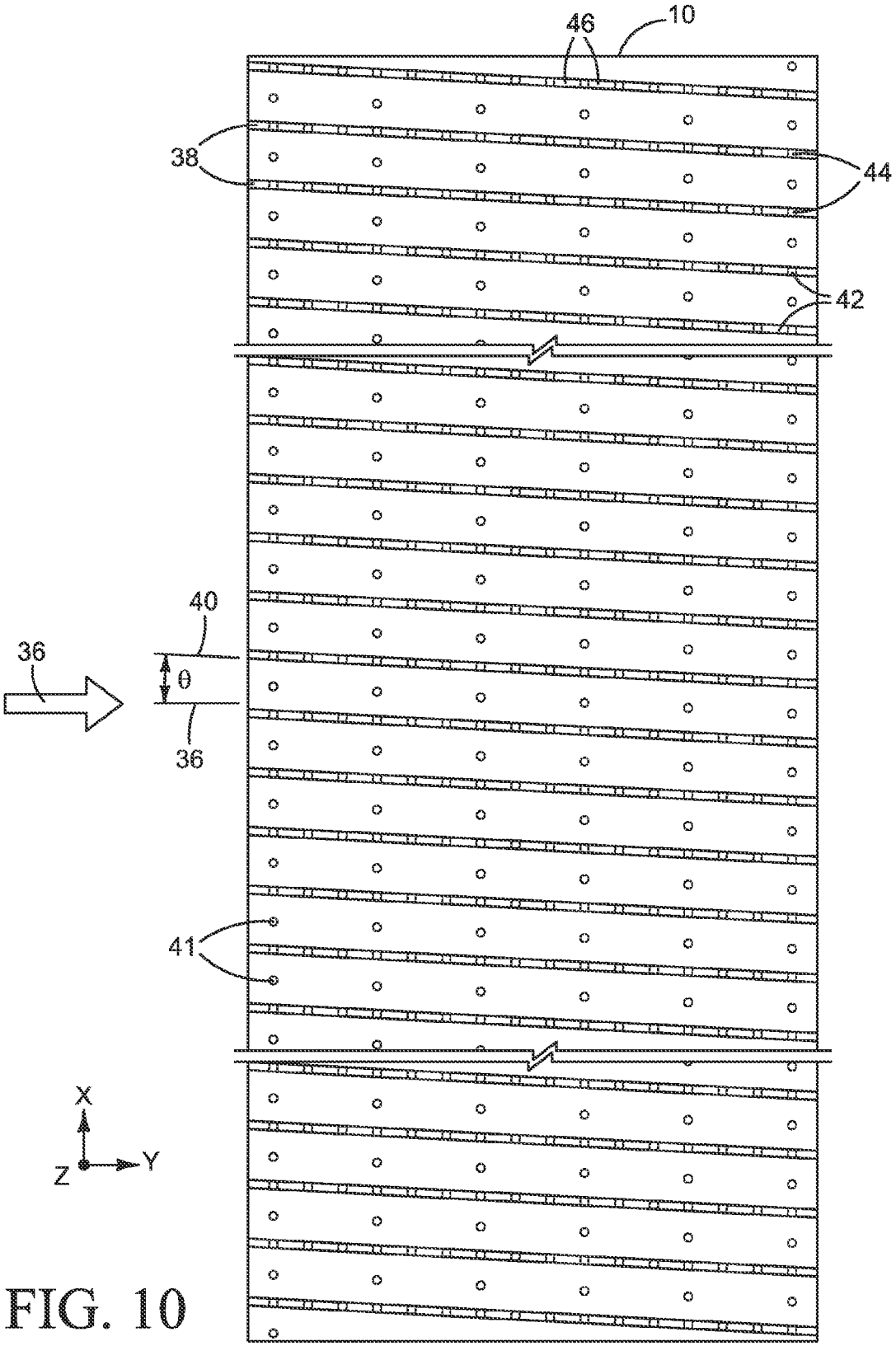
FIG. 10 is a plan view illustrating another example of the new platen in which the substrate support ribs slant diagonally to the right parallel to one another across the full extent of the platen.

In the slanted rib configurations shown in FIGS. 6 and 10, a single group of parallel ribs 38 covers the full substrate support area of platen 12. These configurations urge the print substrate to the left (FIG. 6) or right (FIG. 10) as the substrate passes over the slanted ribs 38 and should be compatible with either center registration (where substrate 26 is registered to the center of platen 12) or edge registration (where substrate 26 is registered to one side of platen 12).

Figure 11:
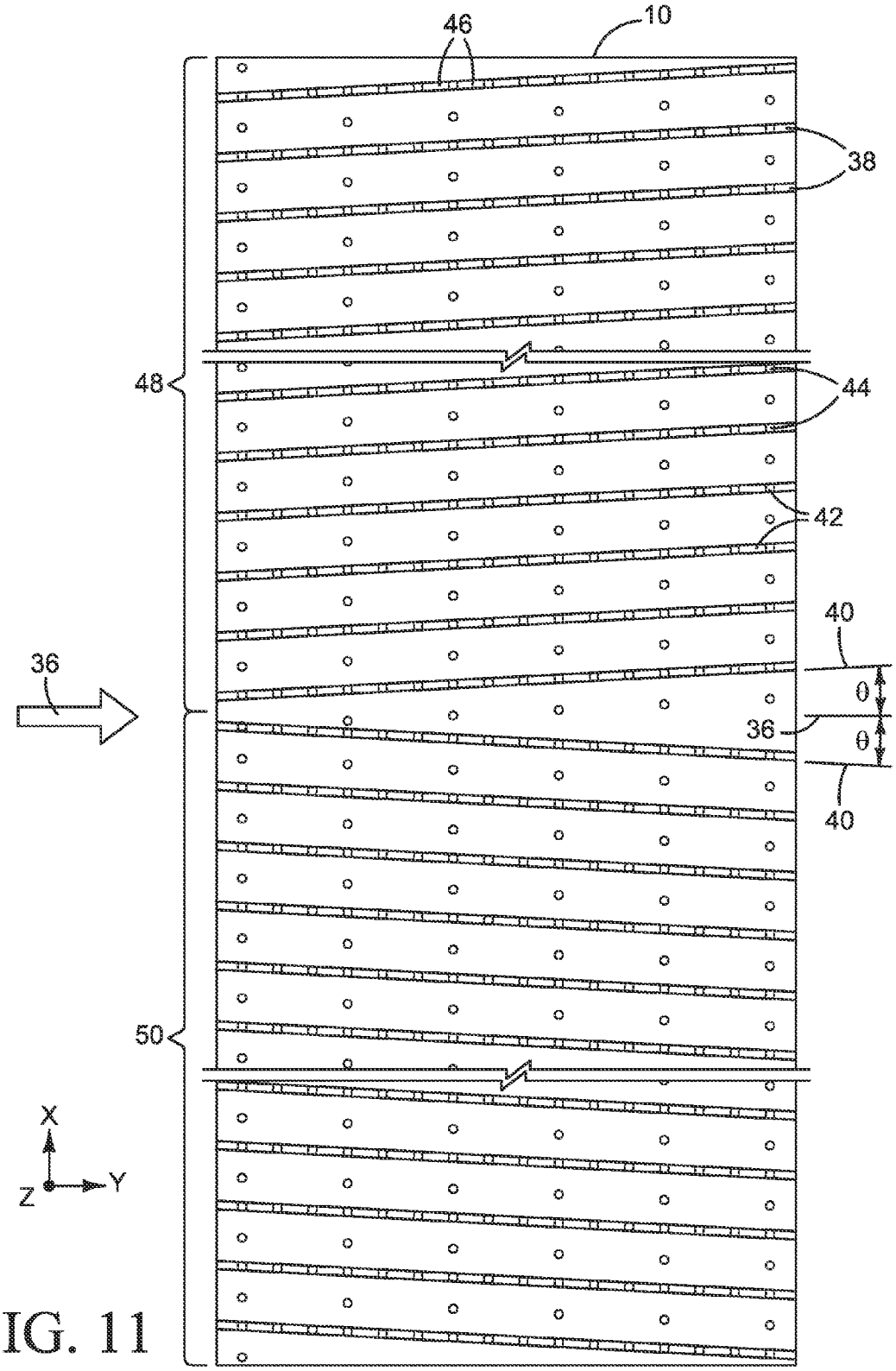
FIG. 11 is a plan view illustrating another example of the new platen in which the substrate support ribs form two groups of parallel ribs that diverge away from one another one another in the substrate direction.
Figure 12:
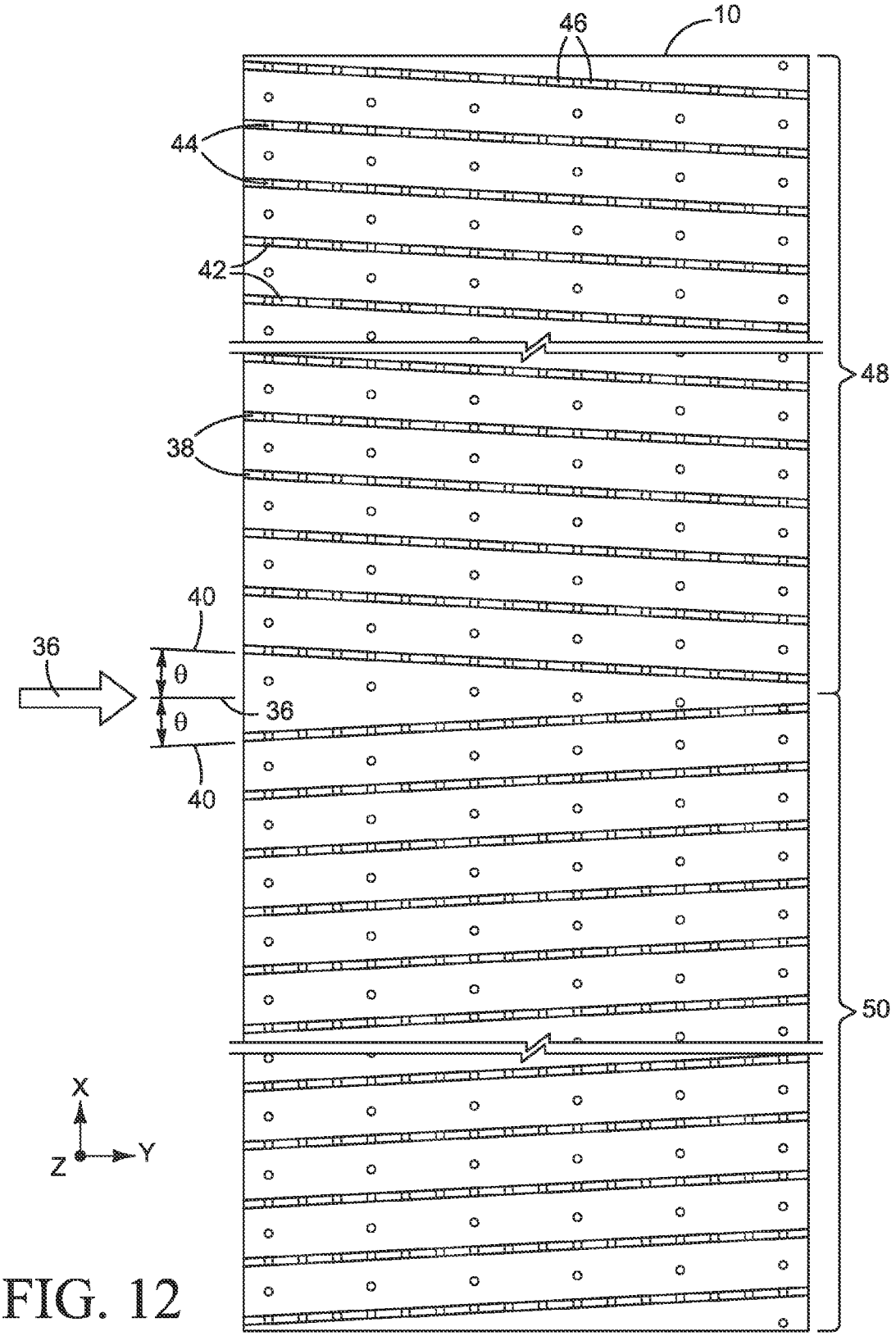
FIG. 12 is a plan view illustrating another example of the new platen in which the substrate support ribs form two groups of parallel ribs that converge toward one another one another in the substrate direction.

In other configurations, shown in FIGS. 11 and 12, two groups 48 and 50 of parallel ribs 38 diverge away from one another (FIG. 11) or converge toward one another (FIG. 12) in substrate direction 36. The diverging rib configuration of FIG. 11 may be useful for print substrates that expand during printing because the diverging ribs tend to drive the expansion of the substrate toward the sides of the platen. The same number of ribs covers more of the platen downstream where the width of an expanding substrate may be greater. The converging rib configuration of FIG. 12 may be useful for print substrates that contract during printing because the converging ribs tend to drive the contraction of the substrate toward the center of the platen. The same number of ribs covers less of the platen downstream where the width of a contracting substrate is smaller.

One of the advantages of the new diagonal rib platen is that some conventional rib designs are readily adapted to the new configuration. For example, it has been observed that the peak/valley ribs currently used in a sinusoidal configuration in some large format scanning printhead roll-to-roll web printers may be reconfigured as diagonal ribs to substantially eliminate visible banding. Testing indicates the following configuration values substantially eliminate visible banding when inkjet printing and drying latex ink on paper or plastic based web substrates:

Slant angle $\theta=8°$

Spacing between ribs=23 mm

Rib height (peak to valley)=0.8 mm to 1.5 mm

Vacuum level=15 mm/H2O

While the desired configuration values may vary depending on the specific printing environment, the following values are expected to reduce or eliminate visible banding for many web substrate latex ink printing environments:

Slant angle $\theta=6°$ to 20°

Spacing between ribs (center to center)=20 mm to 30 mm

Rib height (above base at the peak)=0.5 mm to 2.0 mm

Vacuum level=10 mm/H2O to 30 mm/H2O

For multi-pass printing the rib angle and substrate advance distance are selected so that, as the printheads dispense ink in each direction back and forth across the print substrate and the substrate advances, each part of the image area is printed at a high point (where the substrate is closest to the printheads), at a low point (where the substrate is furthest from the printheads), and at a mid-point between the high and low points and, thus, no banding is visible. For a typical substrate advance distance of about 32 mm, a slant angle less than 6° will act as if the ribs are aligned to the substrate direction, increasing the incidence of visible banding. If the slant angle is more than 20°, each part of the image area may not pass through each print height (high, low, and middle).

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A platen for supporting a print substrate, the platen comprising multiple support surfaces that together define a substrate support area of the platen, wherein the multiple support surfaces comprise:

a first group of support surfaces oriented parallel to one another along a first line that is oblique to a direction the print substrate is to pass over the multiple support surfaces when the platen is in use in a printer or other liquid dispenser, wherein the first line is oriented at an angle in the range of 6° to 20° with respect to the direction, and the support surfaces in the first group of support surfaces are spaced apart from one another in the range of 20 mm to 30 mm, a second group of support surfaces oriented parallel to one another along a second line that is oblique to the direction, and the first and second lines converge toward one another or diverge away from one another, wherein each respective support surface of the multiple support surfaces forms peaks and valleys along a length of the respective support surface.

2. The platen of claim 1, wherein each support surface in the first group of support surfaces is parallel to all of the other support surfaces in the first group of support surfaces, and each support surface in the second group of support surfaces is parallel to all of the other support surfaces in the second group of support surfaces.

3. The platen of claim 1, wherein the support surfaces in the first group of support surfaces converges towards the support surfaces in the second group of support surfaces.

4. The platen of claim 1, wherein the support surfaces in the first group of support surfaces diverge away from the support surfaces in the second group of support surfaces.

5. A platen for supporting a print substrate in a printer, the platen comprising:

a first group of ribs arranged diagonally across a substrate support area with respect to a substrate direction of movement of the print substrate across the platen, the ribs in the first group of ribs parallel to each other and extending in a first direction that is oblique to the substrate direction, wherein the ribs in the first group of ribs are slanted diagonally across the substrate support area at an angle in the range of 6° to 20° with respect to the substrate direction, and are spaced apart from one another in the range of 20 mm to 30 mm; and a second group of ribs arranged diagonally across the substrate support area with respect to the substrate direction, the ribs in the second group of ribs parallel to each other and extending in a second direction that is oblique to the substrate direction, the second direction being different from the first direction, wherein each respective rib of the ribs in the first and second groups of ribs forms peaks and valleys along a length of the respective rib.

6. The platen of claim 5, wherein the first direction converges towards the second direction.

7. The platen of claim 5, wherein the first direction diverges from the second direction.

8. A platen for supporting a print substrate, comprising:

a base;

multiple ribs protruding from the base;

multiple openings in the base between every pair of adjacent ribs to establish low pressure between the base and the print substrate supported on the multiple ribs when the platen is in use in a printer or other liquid dispenser, the multiple ribs comprising a first group of ribs parallel to each other and extending in a first slanted direction that is angled with respect to a substrate direction of movement of the print substrate across the platen, and a second group of ribs parallel to each other and extending in a second slanted direction that is angled with respect to the substrate direction, the first slanted direction different from the second slanted direction, wherein the ribs in the first group of ribs are slanted diagonally across the substrate support area at an angle in the range of 6° to 20° with respect to the substrate direction, and are spaced apart from one another in the range of 20 mm to 30 mm, wherein each respective rib of the multiple ribs forms peaks and valleys along a length of the respective rib.

9. The platen of claim 8, further comprising a vacuum source operatively connected to the openings in the base.

10. The platen of claim 9, wherein:

the vacuum source and the openings in the base are configured to establish a pressure between the base and a substrate supported on the ribs in the range of 10 mm/H2O to 30 mm/H2O.

11. The platen of claim 8, wherein the ribs in the first and second groups of ribs are arranged diagonally across a substrate support area such that each part of an image printed on the first substrate is printed at a high point where the print substrate is closest to a printhead, at a low point where the print substrate is farthest from the printhead, and at a midpoint between the high and low points.

12. The platen of claim 8, wherein the first slanted direction converges towards the second slanted direction.

13. The platen of claim 8, wherein the first slanted direction diverges away from the second slanted direction.

* * * * *